US008295690B2

(12) United States Patent
Brooke et al.

(10) Patent No.: US 8,295,690 B2
(45) Date of Patent: Oct. 23, 2012

(54) INFRARED HEATING MECHANISM AND SYSTEM

(76) Inventors: Scott A. Brooke, West Branch, IA (US); Jeff C. Reed, Muscatine, IA (US); Donovan Douglas, Muscatine, IA (US)

( * ) Notice: Subject to any disclaimer, the term of this patent is extended or adjusted under 35 U.S.C. 154(b) by 13 days.

(21) Appl. No.: 11/823,882

(22) Filed: Jun. 30, 2007
(Under 37 CFR 1.47)

(65) Prior Publication Data

US 2009/0003808 A1 Jan. 1, 2009

(51) Int. Cl.
*A45D 20/40* (2006.01)

(52) U.S. Cl. ..... 392/407; 392/435; 392/354; 392/356

(58) Field of Classification Search ..... 392/354, 392/356, 407, 435
See application file for complete search history.

(56) References Cited

U.S. PATENT DOCUMENTS

| | | | | | |
|---|---|---|---|---|---|
| 1,617,916 | A | * | 2/1927 | Kercher et al. | 392/375 |
| 1,701,096 | A | * | 2/1929 | Bowling et al. | 392/356 |
| 2,391,207 | A | * | 12/1945 | Van Schaack | 392/354 |
| 2,438,670 | A | * | 3/1948 | MacDonald et al. | 392/354 |
| 2,527,013 | A | * | 10/1950 | Kjelgaard | 392/356 |
| 2,573,121 | A | * | 10/1951 | Wandelt | 34/635 |
| 2,678,372 | A | * | 5/1954 | Salton | 219/220 |
| 2,866,066 | A | * | 12/1958 | Neely | 219/536 |
| 3,005,081 | A | * | 10/1961 | Griffith et al. | 219/473 |
| 3,356,829 | A | * | 12/1967 | Brandenburg | 392/435 |
| 3,476,913 | A | * | 11/1969 | Berve et al. | 392/356 |
| 3,973,101 | A | * | 8/1976 | Bosse | 392/369 |
| 3,989,927 | A | * | 11/1976 | Erb | 392/344 |
| 4,195,687 | A | * | 4/1980 | Taziker | 165/129 |
| 4,428,418 | A | * | 1/1984 | Beasley et al. | 165/76 |
| 4,939,344 | A | * | 7/1990 | Perala | 392/354 |
| 5,028,760 | A | * | 7/1991 | Okuyama | 392/435 |
| 5,058,196 | A | * | 10/1991 | Nakamura et al. | 392/435 |
| 5,350,927 | A | * | 9/1994 | Rakhimov et al. | 250/504 R |
| 7,639,928 | B2 | * | 12/2009 | Coke | 392/367 |

* cited by examiner

*Primary Examiner* — Thor Campbell
(74) *Attorney, Agent, or Firm* — McKee, Voorhees & Sease, P.L.C.

(57) ABSTRACT

The ECOWAVE 1.2 is an infrared heater that can produce heat in a more efficient manner than other infrared heaters on the market today. We have utilized specific short wave infrared bulbs and specifically manufactured and oriented heat dissipation material, and housing, to capture the maximum amount of infrared waves emitted from the heat source thus providing an optimum ambient temperature rise for a minimal amount of electricity consumed. We have also designed a heater core, in two separate configurations, that can be used in a multitude of capacities depending on the size of the heating case desired, heat required and space available.

14 Claims, 8 Drawing Sheets

FIGURE 1 - TOP VIEW
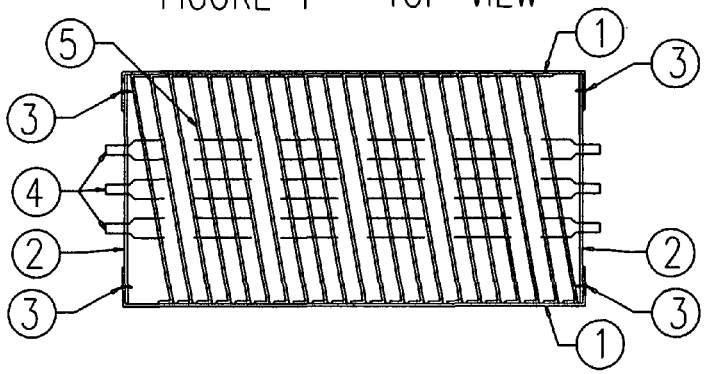
FIGURE 2 - SIDE VIEW
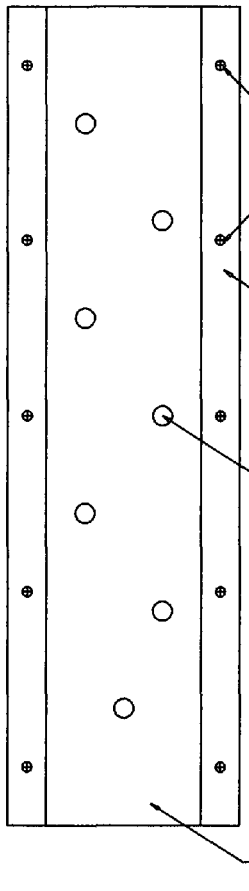
FIGURE 3 - FRONT VIEW
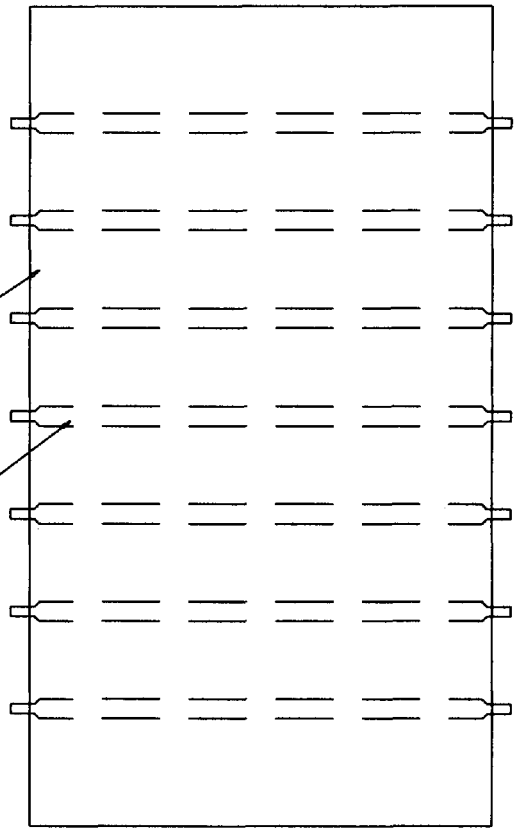

FIGURE 5 – DISSIPATION PLATE
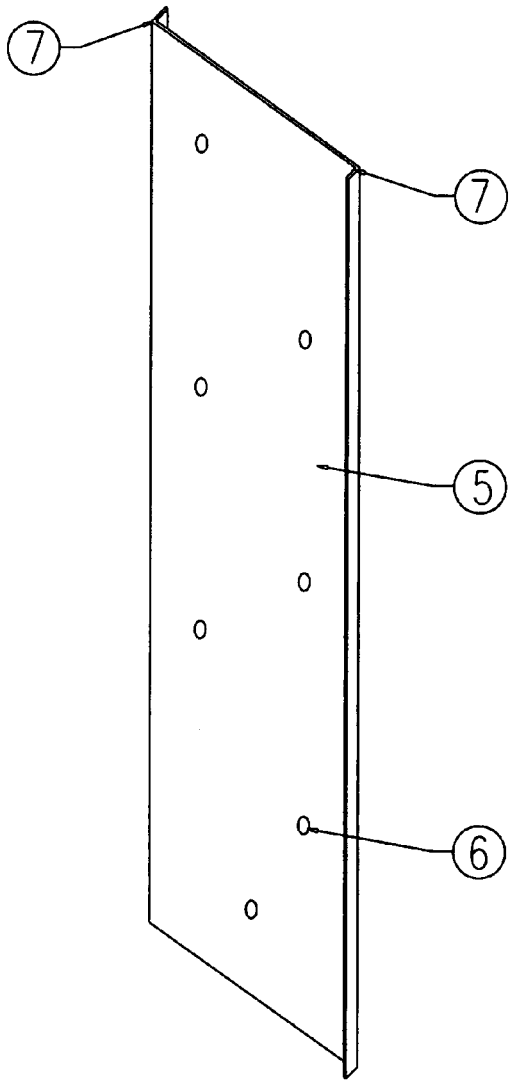

PORTABLE HEATER

R.V. HEATER

ELECTRIC FIREPLACE
HEAT SOURCE

IN WALL HEAT ZONE

IN DUCT ZONE HEAT

STACKABLE HANGING
BAY HEATER

STACKABLE HOME
FURNACE

INFRARED HEATING MECHANISM AND SYSTEM

BACKGROUND OF INVENTION

Infra-Wave Technologies LLC derived an infrared based heater core that will operate to give an optimal rise in ambient temperature with a minimal amount of electrical consumption. We accomplish this by utilizing a short wave infrared bulb, in a specific configuration with specifically designed and oriented dissipation plates, that maximizes contact of the infrared waves with our uniquely designed and oriented heat dissipation plates. Other infrared heaters use outdated infrared bulb technology and do not position the bulbs and heat dissipation plates in a manner that captures the majority of infrared rays, thus not performing in an efficient manner. Our two designs for the heater core can be used in a multitude of configurations, either a single core placement or multiple core placements depending on the heat requirements. Other heaters on the market are only used in a specific heating scenario.

BRIEF DESCPRIPTION OF THE DRAWINGS

FIG. 1 is a sectional view of an exemplary embodiment of the present invention with the section in generally a horizontal plane.

FIG. 2 is a side elevation of FIG. 1.

FIG. 3 is a front elevation of FIG. 1.

FIG. 5 is an isolated view of a dissipation plate extracted from the interior of the assembled embodiment of FIGS. 1-4.

DETAILED DESCRIPTION OF THE INVENTION

Figures 3D, 4:
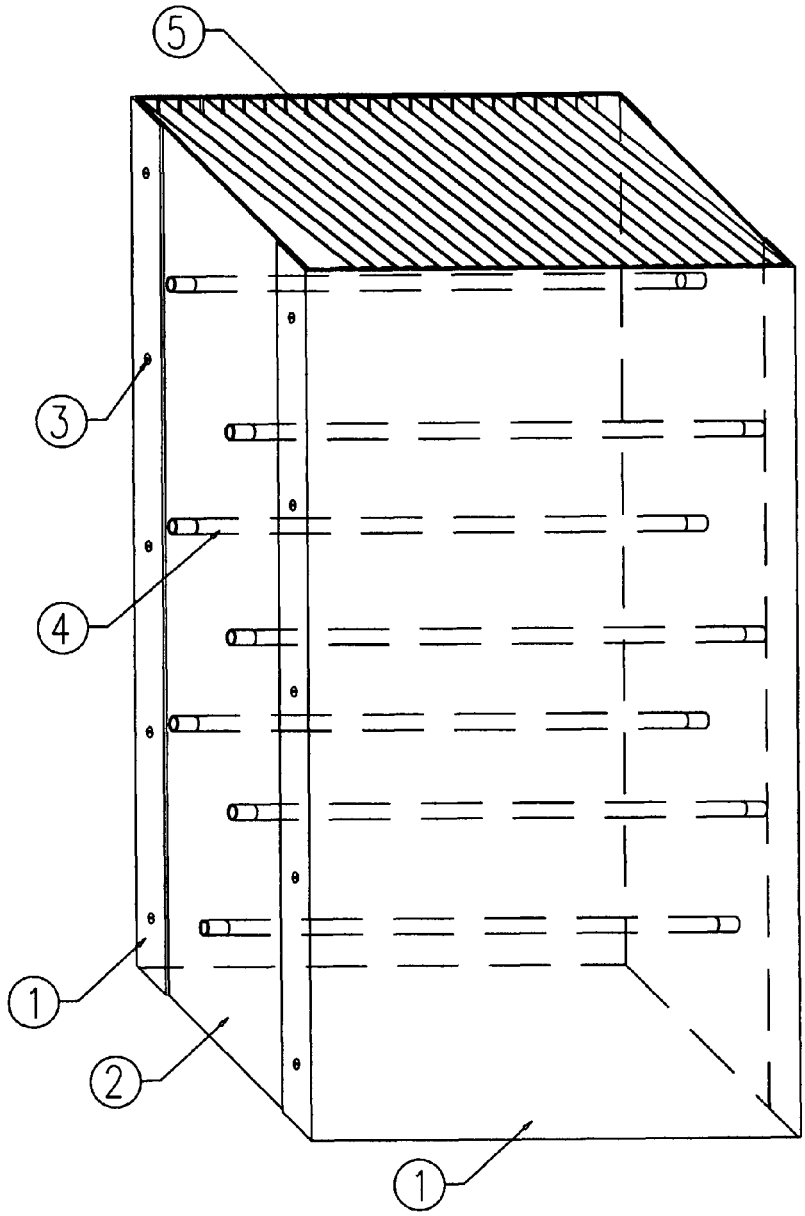
FIG. 4 is a perspective view (not to scale) of the embodiment of FIGS. 1-3.

Infra-Wave Technologies, LLC has designed and developed a new heater core, called ECOWAVE 1.2, that utilizes a combination of infrared light bulbs, metal dissipation plates, thermostatic switches and blower fans in a precise configuration to achieve a 94-96 degree heat rise over ambient temperatures with a minimal electrical consumption of 3.083 KW per hour. Our heater core can produce an optimal rise in ambient temperature with no risk of explosion from volatile gas or heating oil, no risk of carbon monoxide poisoning and will operate at a temperature that is below the point where any material in the heated area of the heater core can combust. The heater core can be used in a multitude of configurations such as a stand-alone space heater, hanging bay heater, wall mounted heater, electric fireplace, and a retrofit unit (either single, direct duct or stacked) into an existing forced air system. See FIGS. 6-12.

The principal behind our Infra-Wave Technologies, LLC heater core is based upon the function of infrared light waves. The disbursement of infrared energy is considered to be by line of site, which requires direct visual contact between the light source and the substrate material to be heated. There are four basic types of infrared energy waves: Long, medium, short and ultra short. The difference between the wave lengths is measured in nanometers and the shorter the light wave the smaller the energy particle being emitted from the light source (the smaller the nanometer number). Depending on the molecular density of the substrate material being heated and the short-light wave, the deeper the penetration of the light's energy particles into the substrate.

The molecular density and thickness of the substrate material is also a critical component of the heater's function. The dissipation plates in the heater core must be of a proper molecular density to allow for the maximum penetration of the short light wave from the infrared light source. In turn the density and thickness also dictates the amount of time for the substrate material to reach maximum output temperature. A less dense material such as thin aluminum will heat up quickly but also dissipate heat quickly. A more dense material such as firebrick will take longer to heat up but will dissipate heat for a longer period of time after the heat elements are turned off. As the infrared light source penetrates the substrate material to be heated the molecules of the substrate material are displaced and the movement of the atoms causes energy to be released. The friction of the atoms being displaced in the substrate material cause a secondary heat source along with the primary heat source from the infrared light bulb.

In coordination with the wave length of the infrared bulb, substrate density and thickness, there is the proximity of the substrate material to the infrared bulb. The further distance that the substrate material is from the infrared light source, along with the actual light wave contact, the less actual energy particles from the light waves will make contact with the substrate material. If the substrate material is close and surrounds the light source 360 degrees, then all light wave particles will make contact with the substrate material and maximize the penetration.

The heater core can be based upon two basic designs. The first design uses seven (7) 2000 watt 2.8 micron infrared short wave light bulbs manufactured by Sea Crome or Ushio America or any comparable manufacturer of a similar short wave infrared bulb. A 1900-CFM fan is used in combination with the bulbs to circulate the air through the unit. The fan is manufactured by Stanley or a comparable manufacturer of a fan that produces a fan of similar size and 90 watts. The second design uses seven (7) 500 watt 1.2 micron infrared bulbs that are a T-3 1.2 Nanometer bulb from any manufacturer of a similar short wave infrared bulb. A 650-CFM fan is used in combination with the bulbs to circulate the air through the unit. The fan is manufactured by Stanley or a comparable manufacturer of a fan that produces a fan of similar size and 90 watts. In both designs the configuration of all elements are of a different configuration in order to optimize the surface contact from the infrared light waves.

The bulbs are mounted in a housing that measures 6" deep× 21" high×12" wide with corners bent at a 90 degree angle and is made of aluminum with the interior finish being highly reflective. The polished interior of the aluminum housing reflects the infrared light waves back into the heat dissipation plates thus increasing the ability of the light waves to make visual contact with the dissipation plates. Furthermore, the polished interior minimizes the amount of energy penetration into the heater core housing and focuses the energy particles into the dissipation plates. At the base of the housing is mounted the fan of the appropriate size for the design. The fan is mounted into the base of the housing in a circular structure that is large enough to encompass the fan and motor unit. The fan housing attaches by self-tapping steel fasteners into the main heater core housing unit. The function of the fan is to bring in fresh air and force out the heated air from the heat exchange area of the heater core. See FIG. 6. The fan is mounted 3" from the first heating element, in order to give an initial boost in ambient air temperature by immediately bringing input air into contact with the heating elements of the heater.

On the inside of the housing for the heater core are 22 carbon steel heat dissipation plates. Carbon steel has a molecular density that will allow deep penetration of the short wave particles and retain the heat energy. It is important to place as many plates as possible in the housing in order to maximize surface area of the dissipation plates to the light waves. The carbon steel plates are 4" wide×21" long×16 gauge thick and have 2, 2 inch crimped 10-degree angle flanges that are opposite each other and angled in opposite directions. See FIG. 5. From these crimped flanges the plates are mounted into the housing unit of the heater core with resistant welds. The plates are mounted into the heater core housing and are spaced ½" apart from each plate and are configured in a parallel manner throughout the housing. See FIG. 4. The carbon steel plates are unpolished in order to maximize the amount of energy absorption from the short wave light bulbs. The reason that the heat dissipation plates are spaced at ½" intervals is to maximize surface area and give 100% vision from the light bulbs. In each heat dissipation plate are seven (7) holes drilled to ½" size and are spaced in a specific pattern. The holes in the heat dissipation plates will line up on each parallel dissipation plate that is mounted in the heater core housing. A single infrared light bulb will be mounted in each hole passing though each heat dissipation plate. The bulbs run perpendicular to the heat dissipation plates minus 10 degrees. See FIGS. 1-4. The position of the first infrared bulb in the heat dissipation plate will be in the center of the plates, 2" from the edge of the heat dissipation plate, and will be located closest to the circulation fan. The hole is in the center to initiate even heat flow through the heater core housing. The remainder of the infrared light bulbs will be configured in a staggered pattern that starts at a 45-degree angle from the centered infrared light bulb. The bulbs are 2.5 inches away from each other through the remainder of the heat dissipation plates in the housing; this maximizes the light particle absorption of each infrared light bulb into the dissipation plate material.

The purpose of mounting the infrared light bulbs in this pattern and measurement is to maximize the coverage area that the infrared light bulbs can heat in the heat dissipation plates. The positioning of the bulbs (by angle and separation) through the dissipation plates maximizes the amount of surface area that the light bulbs make contact with thus increasing the amount of the surface area of the plates that will be heated.

The sockets used for the infrared bulbs have a snap in end cap on one end that will be common for all bulbs in the heater core. The sockets are fed by direct wiring from the power control source. When an infrared bulb is burned out or damaged and needs to be replaced, the socket cover of the damaged bulb would be unhooked and the bulb extracted and replace with a new bulb of a similar type. The wires for the sockets are housed in a chase that runs the length of the heater core housing toward the fan housing.

A thermostat is used with the unit to shut off the heater core elements when the ambient temperature reaches the desired level. In addition, when used in a scenario such as a space heater application, a tip switch can be used to shut the heater core off in the event it is knocked over. In addition, a high temperature switch can be used in combination with the heater to turn power off to the heater core in the event the ambient temperature exceeds a specific temperature level.

The heater core is versatile for a number of applications. The rectangular shape of the heater core-housing unit makes it very flexible for stacking multiple units in larger applications. A single heater core unit can be combined with a fan for use as a stand-alone space heater. The heater core can also be used as a heat source for electric fireplace unit. The heater core can also be mounted as an in wall heater unit with an independent thermostat. A single heater core can also be installed directly into the ductwork of an existing home or commercial heating system being tied to the same thermostat controls or independent thermostat control for zone heat. The heater cores can also be combined in a quantity for the user to achieve an appropriate BTU level for the heater. For example the heater cores can be stacked for use in a hanging bay heater or for placement in a home heating system. The basic design of the heater core will not change for any of the above listed applications but would be installed in single or multiple configurations. A connection between all the heater core units with a common power source and thermostat control will be necessary. See FIGS. 6-12.

DRAWINGS

Index of Parts

Item# Qty ( )

1. Heat Exchanger Casing (2)
2. Heat Exchanger End Plates (2)
3. #8×½" self tapping wafer head screws (20)
4. Infrared elements (7)
5. Perforated Metal Dissipation Plates (22)
6. Hole Bored for Element Insertion (7 per plate)
7. 80 degree Brake (2 per plate)
8. Perforations in Metal Plate
9. Directional Hood for Exchanger Applications
10. Attachment Bands for Stacking Exchanger Units
11. Forced Air Blower or Fan
12. Finished Exterior Product Case
13. Finished Case for In-Duct Unit
14. Heated Airflow to the Plenum

DESCRIPTION OF APPLICATION ILLUSTRATIONS

Figure 6:
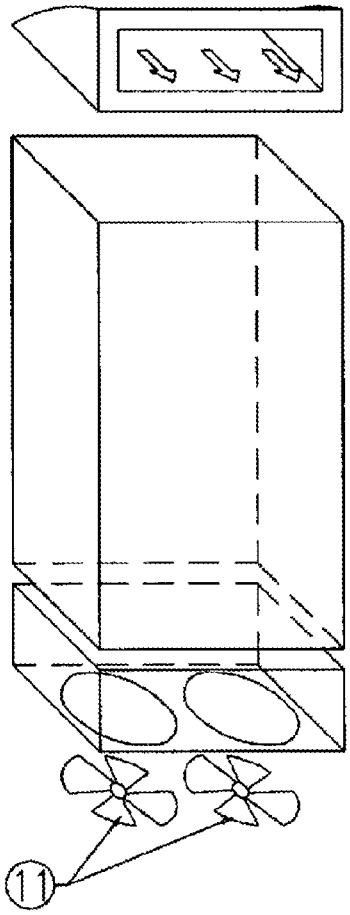
FIGS. 6-12 are diagrammatic prespective illustrations of various alternative enclosures or applications for the type of device shown in FIGS. 1-4.

FIG. 6 Heat Exchanger Utilized as a Portable Heater

Forced air fans (2)

On/Off/Low/High Switch

Tip safety switch

High temperature safety switch

Figure 7:
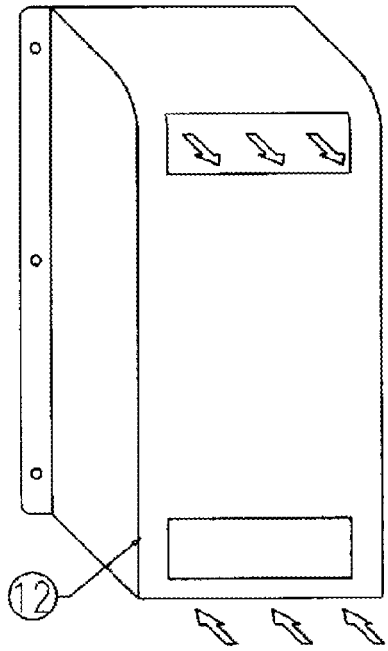

FIG. 7 Wall Mount Recreational Vehicle Heater

Forced air fans (2)

On/Off Switch with thermostat

High temperature safety switch

Brackets for direct mount to wall

Figure 8:
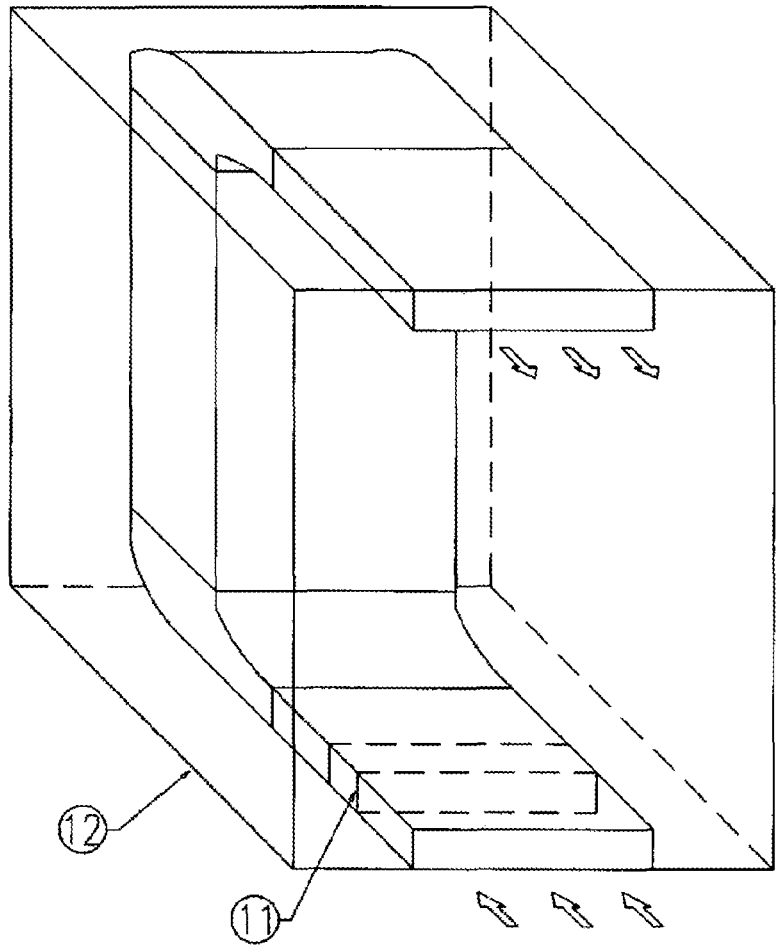

FIG. 8 Electric Fireplace Heat Source

Forced air fan

Ductwork to direct air to front of unit

On/Off/High/Low Switch

High temperature safety switch

Figure 9:
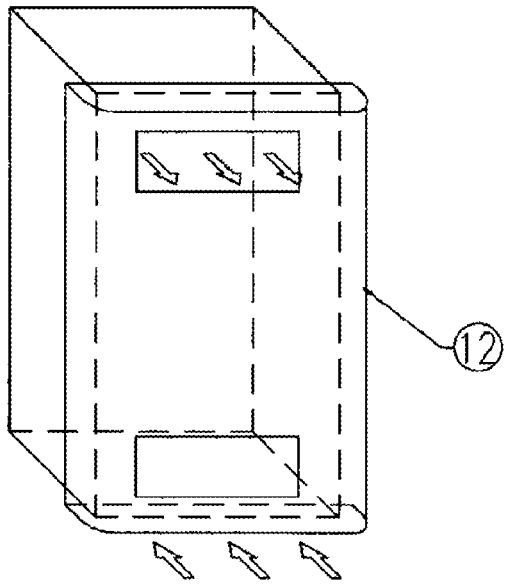

FIG. 9 In Wall Zone Heating Unit

Exterior case designed to fit inside the wall (standard 16" on center stud work)

Forced air fans

Filter bank (preferably HEPA type)

On/Off with thermostat

High temperature safety switch

Figure 10:
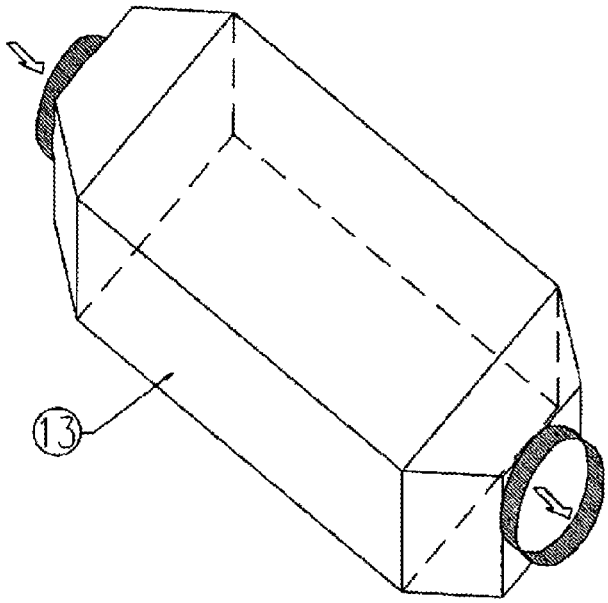

FIG. 10 In Duct Zone Heating

Exterior case designed to mount directly to existing ductwork leaving the plenum.

Figure 11:
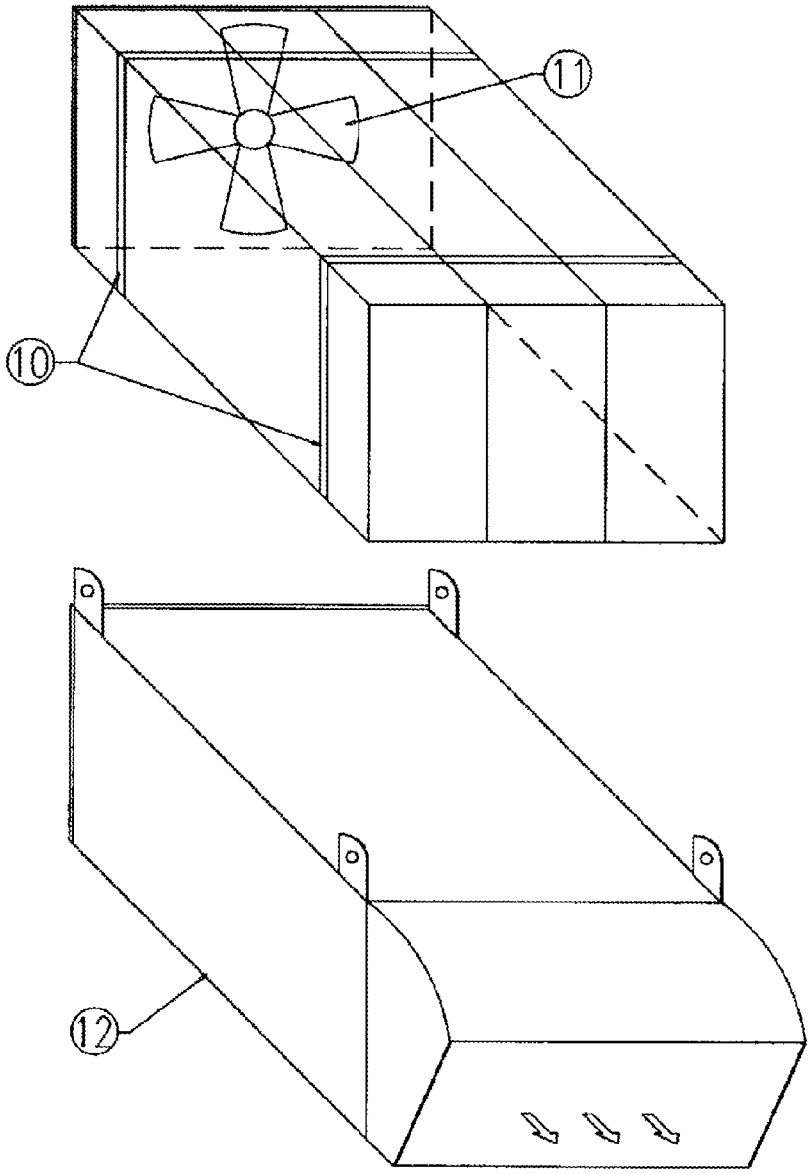

Dual heat home thermostat to allow end user the option of using the existing furnace High temperature safety switch FIG. 11 Stackable Hanging Bay Heater BTU Output is variable to the end users needs by stacking the heat exchangers together and using a forced air fan of proper CFM.

Exterior case capable of being mounted to the ceiling by chain or all thread rods.

Thermostat

High temperature safety switch

Figure 12:
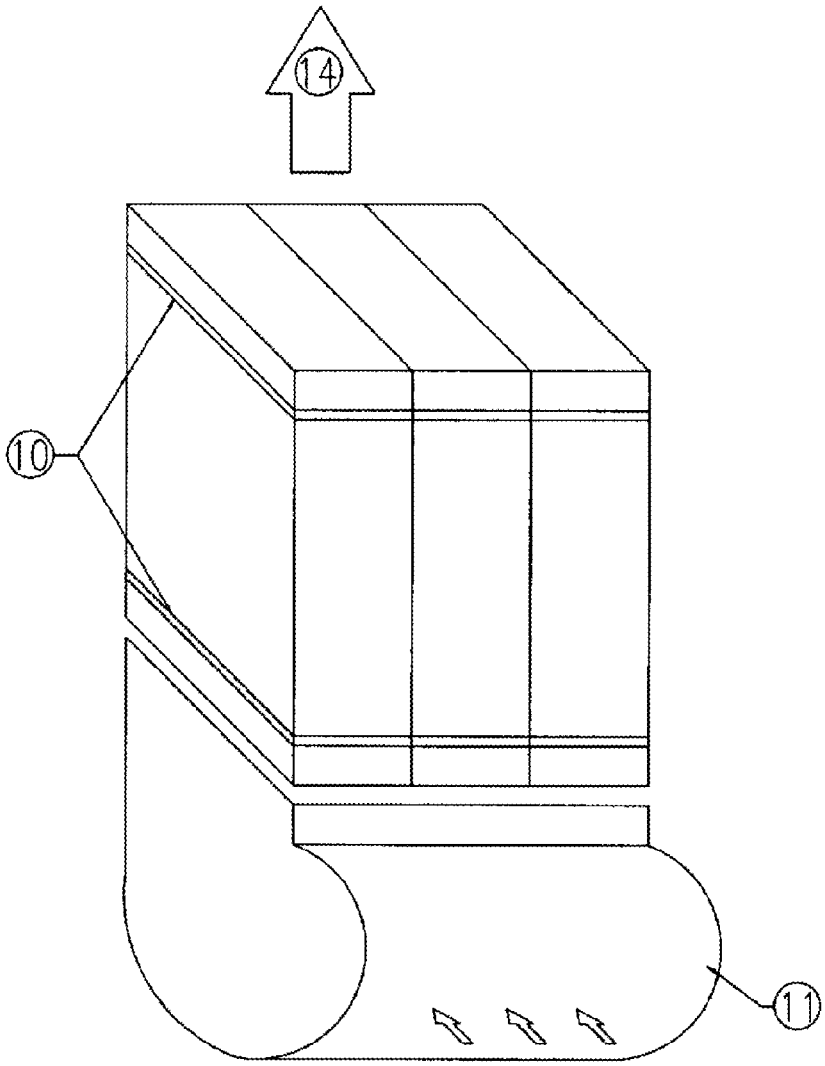

FIG. 12 Stackable Home Furnace

Same as #1 in FIG. 11

Thermostat

Low Temperature/High Temperature switch

The invention claimed is:

1. An infrared heater module apparatus comprising:

a. a plurality of generally parallel but spaced apart infrared-absorbing plates each having opposite faces having surface areas and a thickness between opposite faces; and b. a plurality of elongated, short wave infrared, electromagnetic bulbs, extending transversely through the thicknesses of the plurality of infrared absorbing plates and substantially staggered and spaced apart across the surface areas of the plates;

c. to present a substantial amount of line-of-sight infrared-absorbing surface areas for each electromagnetic bulb to promote efficient transfer of energy from the electromagnetic energy bulb by the electromagnetic bulbs to the infrared-absorbing plates.

2. The module of claim 1 wherein electromagnetic bulb comprises a shortwave infrared light source.

3. The module of claim 1 wherein the shortwave infrared light source comprises between approximately 2.8 micron and 1.2 micron infrared light.

4. The module of claim 1 wherein the infrared-absorbing plates comprise plates having a length, width and thickness and opposite sides.

5. The module of claim 4 wherein the plate comprises a metal plate.

6. The module of claim 5 wherein the metal plate comprises carbon steel.

7. The module of claim 1 wherein each infrared absorbing plate is spaced apart a fraction of an inch from and generally parallel to another infrared absorbing plate, and each electromagnetic bulb is spaced apart a few inches from another electromagnetic bulb.

8. The module of claim 1 wherein the electromagnetic bulb is elongated and generally transverse through the at least several infrared-absorbing members.

9. The module of claim 1 further comprising a housing at least substantially surrounding the plurality of infrared absorbing plates and electromagnetic bulbs and defining an internal chamber, an inlet opening adapted for communication with a source of unheated air, an outlet opening adapted for communication with an application for heated air, so that when the electromagnetic bulbs are operated, infrared energy is transferred to the surface areas of the plural infrared-absorbing plates, and when air is moved between the air inlet and air outlet, the air is heated by dissipation of heat from the infrared-absorbing plates.

10. An infrared heater comprising:

a. an enclosure;

b. first and second heater cores in the enclosure, each heater core comprising:

i. a plurality of generally parallel infrared absorbing plates mounted inside the enclosure, each plate having a peripheral edge and opposite sides;

ii. a plurality of elongated, short wave infrared infrared light bulbs extending through opposite sides of the plurality of plates; and c. a fan positioned relative the enclosure and adapted to move air across the plates of the first and second heater cores.

11. The heater of claim 10 wherein the plurality of light bulbs are staggered relative to one another.

12. The heater of claim 10 wherein the plurality of light bulbs extend substantially perpendicular to the opposing sides of the infrared absorbing plates.

13. The heater of claim 12 wherein substantially perpendicular comprising in the range of perpendicular to +/−10 degrees of perpendicular.

14. An infrared heater module apparatus comprising:

a. a two-dimensional array of a plurality of generally side-by-side but spaced apart infrared-absorbing plates, each having a length, width, thickness, and opposite sides;

b. a two-dimensional array of a plurality of elongated, short wave infrared electromagnetic bulbs capable of emitting at least infrared electromagnetic energy, each extending generally transversely through the plurality of infrared-absorbing plates;

c. the two-dimensional array of electromagnetic bulbs extending transversely through the two-dimensional array of the plurality of infrared-absorbing plates presenting a substantial infrared-absorbing surface area for each electromagnetic bulb to promote efficient transfer of energy from the electromagnetic energy emitted by the electromagnetic bulbs to the infrared-absorbing plates.

* * * * *